United States Patent [19]

Smegal et al.

[11] Patent Number: 5,006,224

[45] **Date of Patent: * Apr. 9, 1991**

[54] START-UP OF A HYDROREFINING PROCESS

[75] Inventors: John A. Smegal; Haluk A. Bilgic; Robert C. Ryan; Vance J. Grieshop, all of Houston, Tex.

[73] Assignee: Shell Oil Company, Houston, Tex.

[ * ] Notice: The portion of the term of this patent subsequent to Apr. 16, 2008 has been disclaimed.

[21] Appl. No.: 361,197

[22] Filed: Jun. 5, 1989

[51] Int. Cl.[5] ..... C10G 23/00

[52] U.S. Cl. ..... 208/254 H; 208/251 H; 208/216 R; 208/217; 208/209; 208/143

[58] Field of Search ..... 208/209, 216 R, 217, 208/254 H, 251 H, 143

[56] References Cited

U.S. PATENT DOCUMENTS

| | | | |
|---|---|---|---|
| 2,953,519 | 9/1960 | Bercik et al. | 208/143 |
| 2,954,339 | 9/1960 | Beavon | 208/216 |
| 3,053,758 | 9/1962 | Georgs | 208/209 |
| 3,287,258 | 11/1966 | Mason | 208/254 H |
| 3,291,722 | 12/1966 | Taylor et al. | 208/254 H |
| 3,368,965 | 2/1968 | Schuman | 208/143 |
| 3,423,307 | 1/1969 | McKinney et al. | 208/213 |
| 3,528,910 | 9/1970 | Haney et al. | 208/216 |
| 3,953,321 | 4/1976 | Ganster et al. | 208/216 |
| 4,098,721 | 7/1978 | Ganster et al. | 252/439 |
| 4,149,965 | 4/1979 | Pine et al. | 208/216 |
| 4,485,006 | 11/1984 | Biceroglu | 208/216 |
| 4,547,285 | 10/1985 | Miller | 208/213 |
| 4,559,130 | 12/1985 | Reynolds et al. | 208/251 H |
| 4,560,465 | 12/1985 | Yu et al. | 208/251 H |
| 4,564,439 | 1/1986 | Kuehler et al. | 208/251 H |

OTHER PUBLICATIONS

164USPQ619 in re Vogel and Vogel, pp. 619–623, Court of Customs and Pat. Appeals.

*Primary Examiner*—Helane Myers

[57] ABSTRACT

The instant invention comprises an improved hydrorefining process which comprises contacting hydrocarbonaceous oil feed and hydrogen with a catalyst comprising a hydrogenation component selected from the group consisting of Group VIB metal component, Group VIII non-noble metal component and mixtures thereof, optionally comprising a phosphorous-containing component or compound, and an alumina-containing support, at hydrorefining conditions, wherein the improvement comprises heating the catalyst at initial start-up from a temperature below about 450° F. to hydrorefining temperature at an average rate of less than 30° F. per hour in the presence of hydrogen and said oil feed.

13 Claims, No Drawings

START-UP OF A HYDROREFINING PROCESS

FIELD OF THE INVENTION

This invention relates to a start-up procedure to be employed with a hydrorefining process, particularly a hydrodenitrification process, which provides for enhanced catalyst activity.

BACKGROUND OF THE INVENTION

Hydrorefining is a well-known process for upgrading a variety of hydrocarbon fractions. The term "hydrorefining" is used herein to designate a catalytic treatment in the presence of hydrogen of a hydrocarbonaceous oil in order to upgrade the oil by eliminating or reducing the concentration of contaminants in the oil such as sulfur compounds, nitrogenous compounds, metal contaminants and/or partial saturation of the oil.

U.S. Pat. Nos. 3,953,321 and 4,098,721 disclose a hydrodesulfurization process for heavy hydrocarbonaceous oils such as gas oils in which a conventional hydrodesulfurization catalyst is sulfided and heat treated at a temperature of 750° F. to 850° F. prior to initiating the hydrodesulfurization. The catalyst is sulfided by contact with a lighter boiling range oil or is heat treated in the presence of the lighter oil, free from sulfur.

U.S. Pat. No. 2,954,339 discloses the use of a spent cobalt-molybdenum-alumina catalyst for hydrodesulfurization of a hydrocarbonaceous oil which may be a gas oil. Prior to contact with the gas oil, the catalyst is used to hydrotreat naphtha.

U.S. Pat. No. 3,423,307 discloses a start-up method for a hydrodesulfurization process for heavy residual feeds which contain asphaltic materials. The catalyst is initially contacted with an asphaltic-free feed.

U.S. Pat. No. 3,528,910 discloses a hydrotreating process for hydrocarbonaceous oils. A catalyst, such as a supported nickel-molybdenum catalyst, is sulfided in the presences of hydrogen with a distillate containing disulfide sulfur prior to the hydrotreating reaction.

U.S. Pat. No 4,149,965 discloses a start-up process for hydrorefining of naphtha. The catalyst is partially deactivated by treatment with a substantially non-metal containing hydrocarbon oil in the presence hydrogen prior to contacting the catalyst with the naphtha feed.

U.S. Pat. No. 3,368,965 discloses a slurry hydrogenation process in which a catalyst, such as cobalt molybdate on alumina, is pretreated by wetting the catalyst with a clean (i.e., non-aromatic) hydrocarbonaceous oil such as a lubrication oil fraction to form a slurry which is then introduced into the hydrocarbonaceous oil to be hydrogenated.

U.S. Pat. No. 3,423,307 utilizes a start-up method comprising initially contacting a hydrorefining catalyst with hydrogen and an asphaltic-free hydrocarbon at a temperature from 250° F. to 500° F. and then gradually increasing the temperature until a temperature within the range of 600° F. and 700° F. is attained, following which hydrorefining of an asphaltic-containing feed is commenced.

U.S. Pat. No. 4,485,006 initiates the hydrorefining process by initially contacting a sulfided hydrorefining catalyst, such as nickel-molybdenum on alumina, with a light hydrocarbonaceous oil boiling in the range of $C_5$ to 700° F., in the presence of hydrogen, and thereafter contacting the catalyst with the heavy hydrocarbonaceous oil to be hydrorefined.

It has now been found that by utilizing the particular slow start-up rate of the instant invention, enhanced catalyst activity can be obtained without the need for initially contacting the catalyst with an oil that is lighter than the feed oil.

SUMMARY OF THE INVENTION

In accordance with the invention there is provided a hydrorefining process which comprises contacting hydrocarbonaceous oil feed and hydrogen with a catalyst comprising a hydrogenation component selected from the group consisting of Group VIB metal component, Group VIII non-noble metal component and mixtures thereof, optionally comprising a phosphorous-containing compound, and an alumina-containing support, at hydrorefining conditions, the improvement which comprises heating the catalyst at initial start-up from a temperature below about 450° F. to hydrorefining temperature at an average rate of less than 30° F. per hour in the presence of hydrogen and said oil feed.

The start-up method of the instant invention results in the hydrorefining catalyst having a higher activity than occurs with a conventional fast start-up. The instant start-up process is particularly suited to hydrodenitrification processes.

DETAILED DESCRIPTION OF THE INVENTION

The start-up method of the instant invention is suited for use at the beginning of a process for hydrorefining hydrocarbonaceous oil feeds in order to remove or reduce the concentration of contaminants in the oil such as sulfur compounds, nitrogenous compounds, metal contaminants and/or partial saturation of the oil. Processes for removing nitrogen contaminants are particularly suited to the application of the method of the instant invention.

Suitable hydrorefining catalysts for use in the process comprise a hydrogenation component and an alumina-containing support. The hydrogenation component is selected from the group consisting of Group VIB metal component and a non-noble metal Group VIII metal component and mixtures thereof, such as cobalt, molybdenum, nickel, tungsten and mixtures thereof. The alumina-containing support may comprise a minor amount of another inorganic oxide such as silica, magnesia, boria, zirconia, strontia, hafnia, phosphorous oxide and mixtures thereof. Preferably the catalyst comprises molybdenum and/or tungsten and cobalt and/or nickel on an alumina support with a phosphorous-containing compound, particularly phosphorous oxide, optionally present. The hydrogenation component of the catalyst may initially be present as elemental metal, metal oxide, metal sulfide and mixtures thereof. When the initial hydrogenation component is not in the sulfided state, then the catalyst, e.g., the nickel oxide-containing catalyst, is sulfided in a conventional manner well-known in the art prior to the start-up of the instant process. Illustrative but non-limiting examples of these presulfiding techniques include contact with hydrogen sulfide gas, organopolysulfides, and elemental sulfur, both powdered and in the vapor state. If the catalyst is not presulfided, it will be sulfided by contact with the sulfur-containing hydrocarbonaceous oil feed during the early part of the hydrorefining process. These hydrorefining catalysts are well known in the art and reference can be made to the prior art, such as but not limited to U.S. Pat. No. 4,530,911 and U.S. Pat. No.

4,534,855 (both incorporated by reference herein) for more specific details about these types of catalysts.

Numerous hydrocarbonaceous oil feedstocks can be utilized in the instant hydrorefining process. Illustrative but non-limiting examples include gasoline fractions, kerosenes, jet fuel fractions, diesel fractions, light and heavy gas oils, deasphalted crude oil residua and the like, any of which may contain up to about 5 weight-percent of sulfur and up to about 3, usually about 0.02 to about 1.5 weight-percent of nitrogen.

Suitable hydrorefining operating conditions are summarized in Table I

TABLE I

HYDROREFINING OPERATION CONDITIONS

| | Conditions | |
|---|---|---|
| | Broad Range | Preferred Range |
| Temperature, °F. | 600–900 | 650–850 |
| Pressure, psig | 600–3500 | 800–3200 |
| Liquid hourly space velocity, V/V/HR | 0.05–5 | 0.1–2.5 |
| Hydrogen rate, SCF/BBL | 300–20,000 | 600–12,000 |
| Hydrogen partial pressure, psig | 500–3000 | 800–2500 |

The catalyst may be disposed in the hydrorefining reaction zone as a fixed bed, moving bed, dispersed phase, fluidized bed, ebullating bed or a slurry. The method of the present invention is particularly suited for use in fixed bed processes.

In general terms, a hydrorefining process utilizing the method of the instant invention will be carried out as follows. The catalyst, preferably presulfided, is loaded into the reactor, the hydrogen is started to the reactor and the reactor is heated to a temperature below about 450° F. The feed to the reactor is then started. The start-up method of the instant process is then commenced, heating to the hydrorefining temperature at an average rate of less than 30° F. per hour. Slower rates such as heating at less than 20° F. per hour or even 10° F. per hour are also satisfactory. Economic factors dictate, however, that as fast a rate as possible which still maintains the high activity of the catalyst will be used in order to minimize non-productive start-up time.

Hydrocarbon feed rates (LHSV) during start-up and during hydrorefining will generally range from about 0.1 to about 10, preferably from about 0.5 to about 5 liters/liter of catalyst/hour. Suitable rates are about 1–2 l/l hr. The hydrogen flow will generally be adjusted to range from about 100 to about 10,000, preferably about 500 to about 5000, more preferably about 800 to about 2000 liters of hydrogen per liter of hydrocarbon feed. Hydrogen partial pressures will range from about 500 to about 5000 psi.

The ranges and limitations provided in the instant specification and claims are those which are believed to particularly point out and distinctly claim the instant invention. It is, however, understood that other ranges and limitations that perform substantially the same function in substantially the same manner to obtain the same or substantially the same result are intended to be within the scope of the instant invention as defined by the instant specification and claims.

The following examples are provided in order to illustrate the invention and are not to be construed as limiting the invention.

ILLUSTRATIVE EMBODIMENTS

A series of experiments were performed to illustrate the advantages arising from the method of the instant invention. The catalyst utilized comprised nickel, molybdenum and phosphorous on an alumina support. The catalyst was presulfided using gas phase sulfidation with hydrogen/hydrogen sulfide (95/5v %).

The operating procedure was as follows. The catalyst was loaded into the reactor and the reactor was heated up to the initial start-up temperature under a hydrogen circulation of about 5.9 standard cubic feet per hour ("SCF/hr") which corresponds to a gaseous hourly space velocity ("GHSV")of 2227 l/l hr. Operating pressure was maintained at about 1800 psig. When the initial start-up temperature was reached, feed was then cut into the reactor at a liquid hourly space velocity ("LHSV") of about 1/hr and the reactor was then heated to the hydrorefining temperature using the "slow" start-up rate of the instant invention.

To measure the catalyst activity, the initial hydrorefining temperature required to provide a product having a residual nitrogen impurity level of 5 ppm was determined. This is referred to as the "Start-of-Run Temperature". This determines the activity of the catalyst for hydrodenitrification. The higher the temperature the poorer the activity.

The properties of the feeds used in the start-up and hydrorefining operations are shown in Table 1. Example 1 was started-up with feed B and switched to feed A when the hydrorefining temperature was reached. Examples 2–4 used feed A throughout. Comparative example 5 used feed A throughout.

TABLE 1

| FEED | A | B |
|---|---|---|
| FEED TYPE | 10% KGHO[a]<br>77% CCLGO[b]<br>9% SRHGO[c]<br>4% KLGO[d] | 100% CCHGO[e] |
| ELEMENTAL ANALYSIS: | | |
| CARBON (WT %) | 88.053 | 87.930 |
| HYDROGEN (WT %) | 10.980 | 10.513 |
| SULFUR (WT %) | 0.434 | 1.210 |
| NITROGEN (WT %) | 0.271 | 0.124 |
| OXYGEN (WT %) | 0.226 | 0.236 |
| DENSITY (60° F.) | 0.9270 | 0.9442 |
| MOLECULAR WT | 219.0 | 247.0 |
| BROMINE NUMBER | — | 10.4 |
| RI @ 20° C. | — | 1.5425 |
| °API | — | 18.21 |
| AROMATICS INDEX | — | 36.0 |
| UV AROMATICS, % WT OF TOTAL C: | | |
| BENZENE | — | 5.72 |
| NAPHTHALENES | — | 14.50 |
| PHENANTHRENES | — | 13.41 |
| CONDENSED TETRAAROMATICS | — | 2.49 |
| TOTAL | — | 36.12 |
| DISTILLATION, TBP-GLC (°F.): | | |
| IBP | 276 | 310 |
| 5% | — | 473 |
| 10% | 452 | 508 |
| 20% | — | 551 |
| 30% | 518 | 583 |
| 40% | — | 612 |
| 50% | 571 | 639 |
| 60% | — | 665 |
| 70% | 622 | 694 |
| 80% | — | 729 |
| 90% | 684 | 773 |
| 95% | 708 | 805 |
| 98% | 734 | — |

TABLE 1-continued

| FEED | A | B |
|---|---|---|
| 99% | 753 | — |
| 99.5% | 885 | 866 |
| BASIC NITROGEN (ppm) | 664 | 77 |
| Ni (ppm) | <.1 | — |
| V (ppm) | <.1 | — |
| Na (ppm) | <.1 | — |
| RCR (wt %) | 0.19 | — |

[a]Flexicoker Heavy Gas Oil
[b]Catalytically Cracked Light Gas Oil
[c]Straight Run Heavy Gas Oil
[d]Flexicoker Light Gas Oil
[e]Catalytically Cracked Heavy Gas Oil Example 5 is a comparative experiment whose start-up was faster than that of the instant invention.

Table 2 lists the start-up conditions and the Start-of-Run Temperature. From the Start-of-Run Temperature it can be seen that the start-up method of the instant invention results in a more active catalyst by at least 10° F. for hydrodenitrification than does the conventional 6 hour start-up (experiment 5).

TABLE 2

| EXP | START-UP FEED | START-UP TIME | INITIAL START-UP | TEMP RATE OF CHANGE TEMP | RUN FEED | START OF RUN TEMP |
|---|---|---|---|---|---|---|
| 1 | B | 9 DAYS | 300° F. | 50° F./DAY TO 600° F.<br>25° F./DAY TO 675° F. | A | 664° F. |
| 2 | A | 72 HRS | 350° F. | 13° F./3 HRS | A | 663° F. |
| 3 | A | 48 HRS | 450° F. | 16° F./3 HRS FOR 24 HRS<br>11° F./3 HRS FOR 24 HRS | A | 664° F. |
| 4 | A | 24 HRS | 450° F. | 26° F./3 HRS | A | 664° F. |
| 5 | A | 6 HRS | 400° F. | 50° F./HR | A | 676° F. |

What is claimed is:

1. In a hydrorefining process which comprises contacting hydrocarbonaceous oil feed and hydrogen with a catalyst comprising a hydrogenation component selected from the group consisting of Group VIB metal component, Group VIII non-noble metal component and mixtures thereof, and an alumina-containing support, at hydrorefining conditions, the improvement which comprises heating the catalyst at initial start-up from a temperature below about 450° F. to hydrorefining temperature at an average rate of less than 10° F. per hour in the presence of hydrogen and said oil feed.

2. The process of claim 1 wherein said hydrorefining conditions include a temperature ranging from about 600° F. to about 900° F. and a total pressure ranging from about 600 to about 3500 psig.

3. The process of claims 1 or 2 wherein the hydrogenation component comprises a metal selected from the group consisting of nickel, cobalt, molybdenum, tungsten, and mixtures thereof.

4. The process of claim 3 wherein the support comprises gamma alumina.

5. The process of any one claims 1, 2 or 4 wherein the catalyst additional comprises a phosphorus-containing component.

6. The process of claim 1 wherein the catalyst at initial start-up is heated from a temperature below about 350° F. to hydrorefining temperature at an average rate of less than 10° F. per hour.

7. The process of claim 6 wherein said hydrorefining conditions include a temperature ranging from about 600° F. to about 900° F. and a total pressure ranging from about 600 to about 3500 psig.

8. The process of claims 6 or 7 wherein the hydrogenation component comprises a metal selected from the group consisting of nickel, cobalt, molybdenum, tungsten, and mixtures thereof.

9. The process of claim 8 wherein the support comprises gamma alumina.

10. The process of claim 9 wherein the catalyst additionally comprises a phosphorous component.

11. A method for starting up a hydrorefining process for a nitrogen impurity-containing hydrocarbonaceous oil feed which comprises:

(a) contacting a hydrorefining catalyst comprising a hydrogenation component selected from the group consisting of nickel, cobalt, molybdenum, tungsten and mixtures thereof on an alumina-containing support with hydrogen and said oil feed at a total pressure ranging from about 800 to about 3000 psig and at a temperature below about 450° F. and heating the catalyst to hydrorefining conditions comprising a temperature ranging from about 600° F to about 700° F. and a total pressure ranging from about 800 to about 3000 psig at an average rate of temperature increase of less than 10° F., and (b) thereafter recovering a hydrorefined hydrocarbonaceous oil having a reduced level of nitrogen impurities.

12. The process of claim 11 wherein the support comprises gamma alumina.

13. The process of any one of claims 11 or 12 wherein the catalyst additionally comprises a phosphorous-containing component.

* * * * *